US008319435B1

(12) United States Patent
Wood et al.

(10) Patent No.: US 8,319,435 B1
(45) Date of Patent: Nov. 27, 2012

(54) METHOD AND APPARATUS FOR OPTICAL FILAMENT LAUNCH

(75) Inventors: James R. Wood, Grapevine, TX (US); Mark K. Browder, Frisco, TX (US)

(73) Assignee: Lockheed Martin Corp., Bethesda, MD (US)

( * ) Notice: Subject to any disclaimer, the term of this patent is extended or adjusted under 35 U.S.C. 154(b) by 1103 days.

(21) Appl. No.: 12/105,106

(22) Filed: Apr. 17, 2008

Related U.S. Application Data

(60) Provisional application No. 60/912,373, filed on Apr. 17, 2007.

(51) Int. Cl.
*H05H 1/00* (2006.01)

(52) U.S. Cl. ..... 315/111.21; 315/111.61

(58) Field of Classification Search ..... 372/9, 23, 372/29.01, 29.02; 343/701; 315/111.11, 315/111.21, 111.61
See application file for complete search history.

(56) References Cited

U.S. PATENT DOCUMENTS

| | | | | |
|---|---|---|---|---|
| 3,105,803 | A * | 10/1963 | Weibel | 376/132 |
| 5,726,855 | A | 3/1998 | Mourou et al. | 361/213 |
| 7,050,469 | B1 | 5/2006 | Lundquist | 372/9 |
| 2004/0041741 | A1* | 3/2004 | Hayes | 343/909 |

OTHER PUBLICATIONS

"Thales Laser, Manufacturer of High Quality Lasers: Nanosecond Lasers, Ultrafast Lasers and Synchronization", webpage information on the ATLAS USPL gathered from the Thales Laser Internet site located at http://thales.nuxit.net/#haut%2Onews, printed Apr. 13, 2008.

"Circular Phase-Mask for Control and Stabilization of Optical Filaments," Thomas Pfeifer, et al, Optics Letters May 22, 2006 doc 68241.

Information regarding an Andrew Flexible Waveguide gathered from the webpage located at: http://www.andrew.com/search/BN_10877.aspx.

"Spatial Light Modulator", webpage information gathered from the Hamamatsu Internet site; home page address: http://sales.hamamatsu.com/en/home.php.

* cited by examiner

*Primary Examiner* — David H Vu
(74) *Attorney, Agent, or Firm* — Lee, Jorgensen, Pyle & Kewalramani, P.C.

(57) ABSTRACT

The invention, in its various aspects and embodiments, comprises a method and apparatus for an optical filament launch. In one aspect, the present invention generates a plurality of plasma filaments defining a radio frequency propagation path. In a second aspect, the present invention generates a pulsed plasma filament RF transmission line.

21 Claims, 3 Drawing Sheets

METHOD AND APPARATUS FOR OPTICAL FILAMENT LAUNCH

The earlier effective filing date of U.S. Provisional Application Ser. No. 60/912,373; entitled, "Method and Apparatus for Optical Filament Launch"; filed Apr. 17, 2007, filed in the name of the inventors James R. Wood and Mark K. Browder, is hereby claimed.

FIELD OF THE INVENTION

This invention relates to a method and apparatus for optical filament generation, and, more particularly, to a method and apparatus for use in generating a radio frequency transmission line using optical filaments.

DESCRIPTION OF RELATED ART

Radio frequency transmission ("RF") frequently occurs wirelessly. However, wireless RF transmission typically experiences a fairly rapid loss in energy. This is particularly detrimental high energy applications. Transmission losses can be mitigated by transmission through, for example, transmission lines, but this are typically fixed in position and lack the flexibility needed for some applications.

The present invention is directed to overcoming, or at least reducing the effects of, one or more of the problems set forth above.

SUMMARY OF THE INVENTION

The invention, in its various aspects and embodiments, comprises a method and apparatus for an optical filament launch. In one aspect, the present invention generates a plurality of plasma filaments defining a radio frequency propagation path. In a second aspect, the present invention generates a pulsed plasma filament radio frequency transmission line.

BRIEF DESCRIPTION OF THE DRAWINGS

The invention may be understood by reference to the following description taken in conjunction with the accompanying drawings, in which like reference numerals identify like elements, and in which.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

In general, a waveguide structure is mechanically tapered to spacing dimension of twin line transmission line structure. The transmission line allows energy to propagate without range squared dependent loss, without the need for large antenna apertures. The impedance in the transmission line can be controlled, improving control of atmospheric breakdown at high energy levels, and providing better matching to directed energy source impedances. Optically direct energy over a swept field of regard from a HPM waveguide structure to an optically steered and optically generated plasma filament transmission line structure. Optical axis of steering is pivoted around the end points of the tapered waveguide section.

Figure 1:
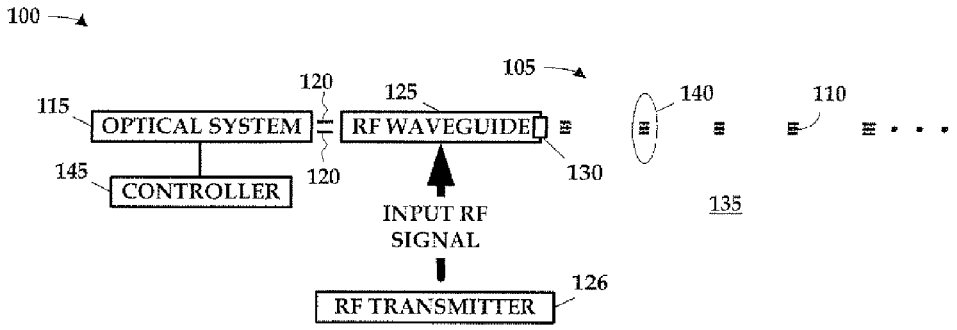
FIG. 1 illustrates a scenario in which the present invention may be used to generate and launch a pulsed plasma filament transmission line over which a pulsed RF signal may be transmitted in accordance with the present invention.

FIG. 1 conceptually illustrates a scenario 100 in which the present invention is used to generate and launch a pulsed plasma filament transmission line 105 over which a pulsed RF signal 110 may be transmitted. In general, an optical system 115 generates a plurality of pulsed optical signals 120 that are emitted into an ambient, gaseous atmosphere 135. An RE waveguide 125 receives a pulsed RF signal from an external source (e.g., RF transmitter 126) that is then transmitted through the aperture 130 thereof. The transmission of the pulsed RE signal 110 and the pulsed laser signals 120 are synchronized so that they enter the ambient, gaseous atmosphere 135 at the same time. Note that the precision of the synchronization need not be absolute such that "same" need not necessarily imply a single exact moment. All that is required is that the synchronization sufficed to establish the functional relationship described below to meet implementation specific requirements for effective range.

Figure 2:
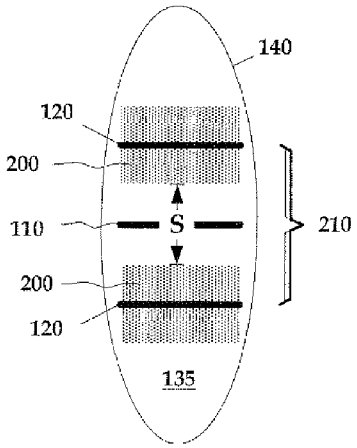
FIG. 2 is an enlarged view of a single pulse of the transmission line first shown in FIG. 1 to illustrate how the pulsed optical signals ionize the gas of the ambient atmosphere to generate a pulsed plasma filament.

As is best shown in FIG. 2 for a single pulse 140 first shown in FIG. 1, the pulsed optical signals 120 each ionize the gas of the ambient atmosphere 135 to generate a pulsed plasma filament 200. The plasma filaments 200 then bound and define a region 210 through which the pulsed RF signal 110 propagates as a transverse electromagnetic wave ("TEM").

In the illustrated embodiment, the nominal separation S of the plasma fibers 200 is approximately a minimum of 100 micrometers. The maximum of the separation S is limited by the available optical aperture. However, minimum and maximum separations will be implementation specific and will vary according to the energy, frequency, and TEM mode of the RF signal 110.

Figure 3:
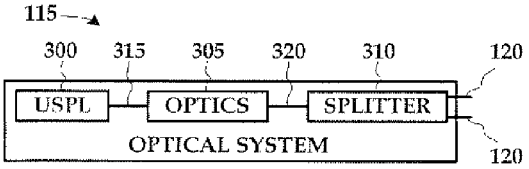
FIG. 3 is a block diagram of one particular embodiment of the optical system of FIG. 1.

FIG. 3 is a block diagram of one particular embodiment of the optical system 115 of FIG. 1. The optical system 115 generally comprises an ultrashort pulse laser ("USPL") 300, a plurality of optics 305, and a beam splitter 315. The USPL 300 generates a single pulsed laser signal 315. Each pulse has self-propagating characteristics in the atmosphere, typically less than 1 picosecond. Each pulse has a dispersive behavior that results in the pulse compressing in the downrange dimension, while the energy deposited in atmospheric propagation nearly exactly decompresses the pulse, such that the pulse downrange dimension stays constant for long ranges.

Suitable USPLs are known to the art for implementing the USPL 300, and any suitable laser known to the art may be used. One suitable, commercially available, off the shelf USPL is the ATLAS available from THALES Laser, at Route départementale 128 BP 46-91401 ORSAY CEDEX FRANCE, ph: +33 (0) 1 69 33 06 94, fax: +33 (0) 01 69 33 02 71, e-mail: thales-laser@fr.thalesgroup.com. According to the vendor, the ATLAS USPL is based on a glass phosphate technology with a typical repetition rate of 1 shot per minute (up to 0.05 Hz) and is designed to deliver 2×25 J in the green (50 J at 527 nm), 20 ns pulse duration with a smooth, Super Gaussian beam profile. Selected information provided by the vendor is set forth in Table 1 below. Additional information regarding this USPL may be obtained from THALES Laser over the Internet at http://thales.nuxit.net/ or at the contacts listed above. Suitable USPLs are also disclosed in the literature, such as U.S. Pat. No. 5,726,855, incorporated by reference below. The reference actually teaches three alternative USPL designs.

TABLE 1

Selected Characteristics - THALES ATLAS USPL

| Characteristic | Quantification |
|---|---|
| Repetition Rate | 1 shot/min to 0.05 Hz |
| Energy per pulse (J) | 50 |
| Wavelength (nm) | 527 |
| Pulse Duration (ns) | <20 |
| Pulse to Pulse Stability (% rms) | <1.2 |
| Polarization | Vertical |
| Beam Diameter (mm) | <40 |
| Beam Profile | Super Gaussian, smooth profile |
| Divergence (full angle mrad.mm) | <4 |

Still referring to FIG. 3, the laser signal 315 is then conditioned by the optics 305. The optics 305 use well known techniques to, for example, shape the beam of the laser signal 315 to meet implementation specific goals driven by the end use for a particular embodiment. This and other types of conditioning are well known to those in the art, and so further discussion will be omitted so as not to obscure the present invention.

The conditioned laser signal 320 is then split by a beam splitter 310. Again, techniques for splitting laser beams are well known, as are the optics used to implement such splitters. Many suitable beam splitters are commercially available off the shelf and any one of them will suffice. In the illustrated embodiment, the beam splitter 310 splits the conditioned beam 320 into two, thereby producing the optical signals 120 previously mentioned. Thus, each optical signal 120 in the illustrated embodiment is a split beam, ultrashort pulse laser signal.

Note, however, that the invention is not so limited. Each plasma filament may be generated from a separate laser signal emitted by a respective USPL in alternative embodiments. That is, the laser signals may be unsplit beams.

Figure 4A:
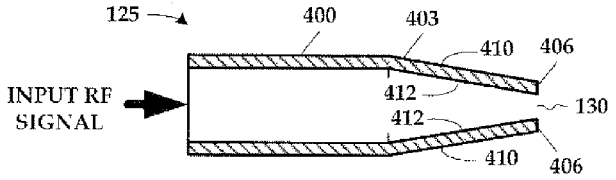
FIG. 4A-FIG. 4B are a conceptualized, cross-sectional side view and a perspective, mechanical view of the RF waveguide of FIG. 1.
Figure 4B:
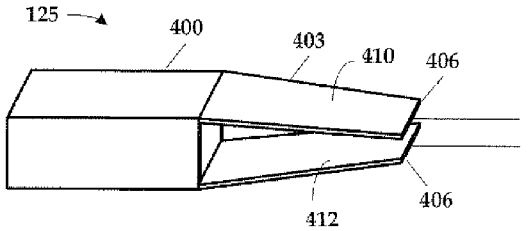

FIG. 4A-FIG. 4B are a conceptualized, cross-sectional side view and a perspective, mechanical view of the RF waveguide of FIG. 1. Note that, in this particular embodiment, the RF waveguide 125 mechanically tapers toward the aperture 130. However, this is not required for the practice of the invention. In the illustrated embodiment, RF waveguide 125 comprises a rectangular waveguide body 400 to which a tapered section 403 has been added.

One suitable waveguide for implementing the waveguide body 400 is a rectangular WR90, a Waveguide Rectangular, 0.9 inch in the long transverse internal cross section dimension, which is a standard product such as Andrew F090CCS1 at http://www.andrew.com/search/BN_10877.aspx. Additional information may be obtained from Andrew Corporation, Worldwide Headquarters3 Westbrook Corporate Center, Suite 900, Westchester, Ill. 60154 United States of America; telephone 1-800 255-1479; facsimile 1-800 349-5444; or electronic mail at AOPcustomersupportcenter@andrew.com. Still more information can be obtained over the World Wide Web of the Internet at the corporate website at www.andrew-.com. However, any suitable waveguide known to the art may be employed.

Returning to FIG. 2, as previously noted, the optical signals 120 generate the plasma filaments 200 as they ionize the gas in the atmosphere 135. Down range, the optical pulse appears, followed by the plasma filament—that is, the laser pulse leaves a plasma in its wake. The RF signal 110 then propagates through the region 210 defined by the confined plasma 200 in an electromagnetic mode.

The plasma connects with a tube, and the tube connects with a coax. More technically, the optical pulse passes through the tubes, leaving a plasma of ionized air in the tube. A similar connection could be made using other geometry, like rectangular plate, where the plasma left behind by the optical pulse contacts the plate surface, each plate is electrically connected to the cable or waveguide. This type of connection can be made for coaxial cable, twin line cable, or waveguide. The waveguide 125, shown in FIG. 4A-FIG. 4B, can provide a conductive plasma contact area by virtue of the tapered section 403 of the waveguide presenting a conductive surface on the inner or outer waveguide taper surfaces 410, 412 to the plasma left behind by optical pulse.

Any known technique for generating plasma filaments from an optical signal may be used. Suitable techniques for generating the plasma filament 200 are known. Such techniques are disclosed in U.S. Pat. No. 5,726,855, U.S. Pat. No. 7,050,469, and Thomas Pfeifer, et al., "Circular Phase-Mask for Control and Stabilization of Optical Filaments," Optics Letters 22 May 2006 doc 68241. One technique disclosed in U.S. Pat. No. 5,726,855, incorporated by reference below, employs a doubling crystal.

The technique in Pfeifer et al. employs a Hamamatsu reflector element called a spatial light modulator ("SLM") operation to generate, control and improve optically generated filaments. The SLM is used as part of the laser system as a final mirror which directs the optical pulse and "seeds" formation of the plasma filament behind the optical pulse. The Hamamatsu device is programmable, useful in aiming and compensating for laser beam changes during scanning, heating changes during operation, etc. Additional information is available from Hamamatsu Photonics, K.K., 360 Foothill Rd, Bridgewater, N.J. 08807, telephone: 908-231-0960, facsimile: 908-231-1218, or over the Internet at http://sales.hamamatsu.com/en/home.php.

The illustrated embodiment shows only two plasma filaments 200, but any number greater than two may be employed. One technique for scaling up the number of filaments is disclosed in the aforementioned U.S. Pat. No. 7,050,469.

Returning to FIG. 1, the optical system 115 optically steers and optically generates the plasma filament transmission line structure 105 comprised of a plurality of a plurality of plasma filaments 200, shown in FIG. 2. The transmission line structure 105 has an optical axis (not shown) of steering pivoted around the end points 406, shown in FIG. 4, of the RF waveguide 125 defining the exit aperture 130. This is better illustrated in Appendix A hereto, incorporated by reference below. Thus, the waveguide structure is mechanically tapered to spacing dimension of twin line transmission line structure and the optical axis of steering is pivoted around the end points of the tapered waveguide section. To this end, the optical system 115 also includes optics (not shown) that will operate under the direction of the controller 145 to scan the optical signals in azimuth and elevation.

Figure 5:
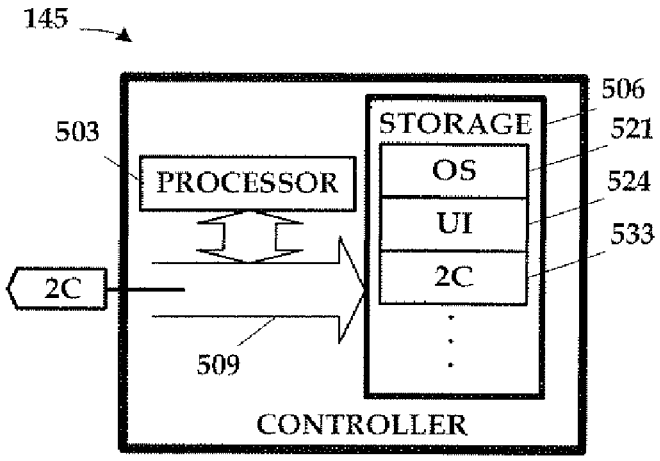
FIG. 5 illustrates selected portions of one particular embodiment of the controller first shown in FIG. 1.

Selected portions of one particular embodiment of the controller 145 are shown in FIG. 5. The controller 145 includes a processor 503 communicating with storage 506 over a bus system 509. In general, the controller 145 will handle a fair amount of data, some of which may be relatively voluminous by nature and which is processed quickly. Thus, certain types of processors may be more desirable than others for implementing the processor 503. For instance, a digital signal processor ("DSP") may be more desirable for the illustrated embodiment than will be a general purpose microprocessor. In some embodiments, the processor 503 may be implemented as a processor set, such as a microprocessor with a mathematics co-processor.

The storage 506 may be implemented in conventional fashion and may include a variety of types of storage, such as a hard disk and/or random access memory ("RAM"). The storage 506 will typically involve both read-only and writable memory implemented in disk storage and/or cache. Parts of the storage 506 will typically be implemented in magnetic media (e.g., magnetic tape or magnetic disk) while other parts may be implemented in optical media (e.g., optical disk). The present invention admits wide latitude in implementation of the storage 506 in various embodiments. The storage 506 is also encoded with an operating system operating system ("OS") 521, some user interface ("UI") software 524, and a command and control ("2C") component 533. The processor 503 runs under the control of the OS 521, which may be practically any operating system known to the art. The 2C component 533 may be implemented as an application or as a utility or daemon that operates in the background. The structure of the software architecture for the controller 145 is not material to the practice of the invention.

Note that some portions of the detailed descriptions herein are presented in terms of a software implemented process involving symbolic representations of operations on data bits within a memory in a computing system or a computing device. These descriptions and representations are the means used by those in the art to most effectively convey the substance of their work to others skilled in the art. The process and operation require physical manipulations of physical quantities. Usually, though not necessarily, these quantities take the form of electrical, magnetic, or optical signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated or otherwise as may be apparent, throughout the present disclosure, these descriptions refer to the action and processes of an electronic device, that manipulates and transforms data represented as physical (electronic, magnetic, or optical) quantities within some electronic device's storage into other data similarly represented as physical quantities within the storage, or in transmission or display devices. Exemplary of the terms denoting such a description are, without limitation, the terms "processing," "computing," "calculating," "determining," "displaying," and the like.

Note also that the software implemented aspects of the invention are typically encoded on some form of program storage medium or implemented over some type of transmission medium. The program storage medium may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The invention is not limited by these aspects of any given implementation.

Returning to FIG. 5, the 2C component 533 issues 2C commands to the optics (not shown) that steer the plasma filaments 200 and, hence, the transmission line structure 105. These optics may include conventional scanning structures such as scanning mirrors and/or acousto-optic modulators that are well known to the art. Some embodiments of the present invention may also gimbal all or part of the optics to provide some of the scanning using techniques well known to the art. Other optical components such as turning mirrors known to the art for achieving optical alignment may also be employed.

For example, in one particular embodiment, the apparatus shown in FIG. 1 may be employed with a telescope (not shown). The telescope moves with the waveguide and the waveguide and telescope are on a gimbal (not shown). The gimbal is coupled to the RF source (not shown) of the input RF signal by a waveguide rotary joint (not shown) or RF cable (not shown). The laser (i.e., the USPL 300, shown in FIG. 3) is coupled into the gimbal by scan mirrors (not shown).

Alternatively, in another embodiment, the telescope stays fixed, the laser is scanned across the available field of regard of the telescope aperture, and the RF waveguide connection point to the plasma filaments 200 is moved to maintain alignment and contact with the plasma filaments 200. The idea is, no matter how one chose to scan the plasma filaments 200, the RF connection is maintained, either by hard fixing to telescope aperture, servo mechanism to keep RF aligned with filaments from fixed telescope, or some combination.

As those in the art will appreciate, the pulsed plasma filaments and the RF signal pulses will propagate through the ambient atmosphere at different speeds. More particularly, the plasma filaments are formed at very near the speed of light in the medium, i.e., the ambient atmosphere, while the RF signals contained on the transmission line formed by the remnant plasma filaments propagate significantly slower than the speed of light. The difference in the propagation speeds will eventually reach a point at which the RF signal can no longer stay within the propagation path defined by the plasma filaments. While, the RF energy will propagate after the plasma filaments no longer confine it in transmission line mode, its energy will begin to radiate in omnidirectional way, such that it will lose energy as 1/r2, where r is the range. This is not always undesirable, but it is for the applications in which the present invention may be employed.

The point at which the plasma filaments outrace the RF signal will mark the end of the effective range of the transmission line as the RF signal will no longer be able to effectively propagate through the unionized atmosphere 135. The nominal effective range of the transmission line 105 in the illustrated embodiment is approximately 300 m. However, the effective range will also vary among embodiments according to the range to the desired target, the energy of the RF signal 110 to place on the target, the frequency of the energy of the RF signal 110, and the electromagnetic mode of propagation on the plasma filaments 200.

The transmission line allows energy to propagate without the range squared dependent loss incurred in conventional antenna based RF transmission systems, without the need for large antenna apertures. The impedance in the transmission line can be controlled, improving control of atmospheric breakdown at high energy levels, and providing better matching to directed energy source impedances.

Figure 6:
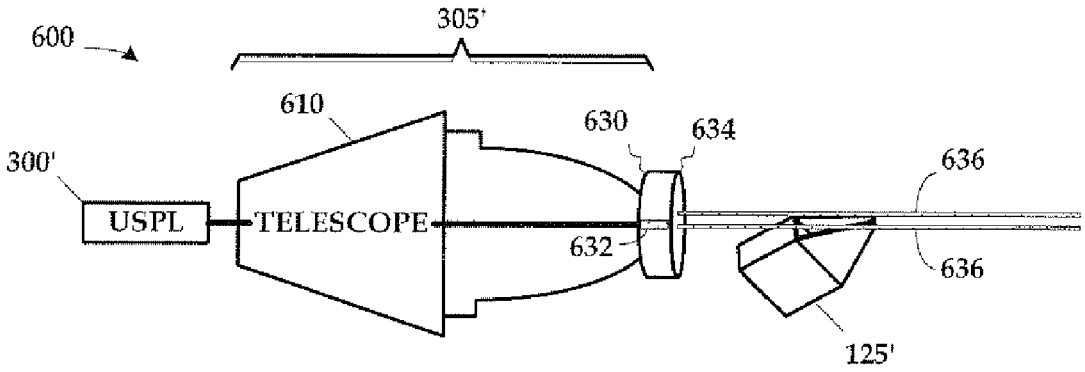
FIG. 6 depicts one particular implementation of the embodiment of FIG. 1.

One particular implementation 600 is depicted in FIG. 6. The implementation 600 includes an USPL 300' and optics 305' as discussed above. Note that the optics 305' includes a telescope 610. The USPL 300' generates a laser signal 620 as described above that is treated by the optics 305'. A phase plate 630, such as that taught in U.S. Pat. No. 7,050,469, then seeds a plasma filament 632. A second phase plate 634, also as taught in U.S. Pat. No. 7,050,469, then splits the plasma filament 632 into a pair of plasma filaments 636. To further an understanding of this aspect of the implementation, a brief, modified excerpt of U.S. Pat. No. 7,050,469 follows.

Figure 7:
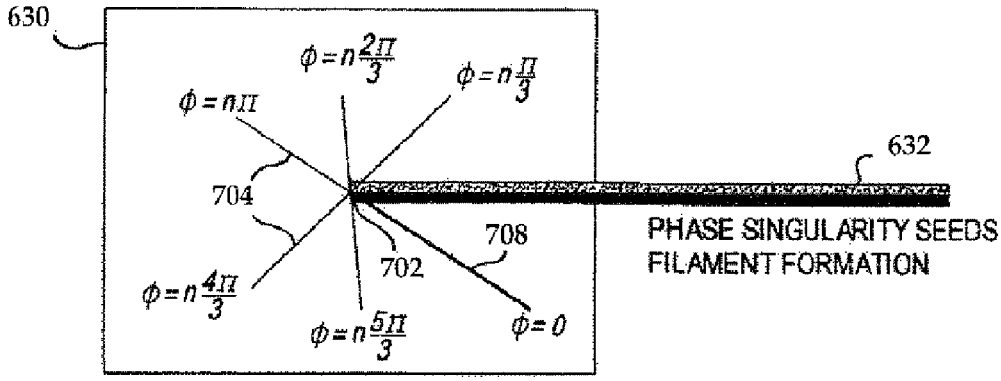
FIG. 7-FIG. 8 conceptually illustrate phase plates used in generating and splitting a plasma filament in the implementation of FIG. 6.

FIG. 7 shows a phase plate 630 that can be used to seed optical filaments. The phase plate 630 shown is an $n^{th}$ order singularity phase plate having a phase singularity 702. The variation in phase around the singularity 702 is indicated in the drawing by lines 704 of equal phase. The singularity 702 seeds the formation of a filament 632. The phase plate 630 is branch cut at phase $\Phi=0$ represented by an n*wavelength ledge 708 or a phase discontinuity.

The orders of the singularities can be selected to control filament properties such as size and inner null diameter. Thus, whether the phase plate has a single singularity or multiple singularities, the order or orders of the singularity or singularities can be selected to provide the appropriate control over the filament properties.

Figure 8:
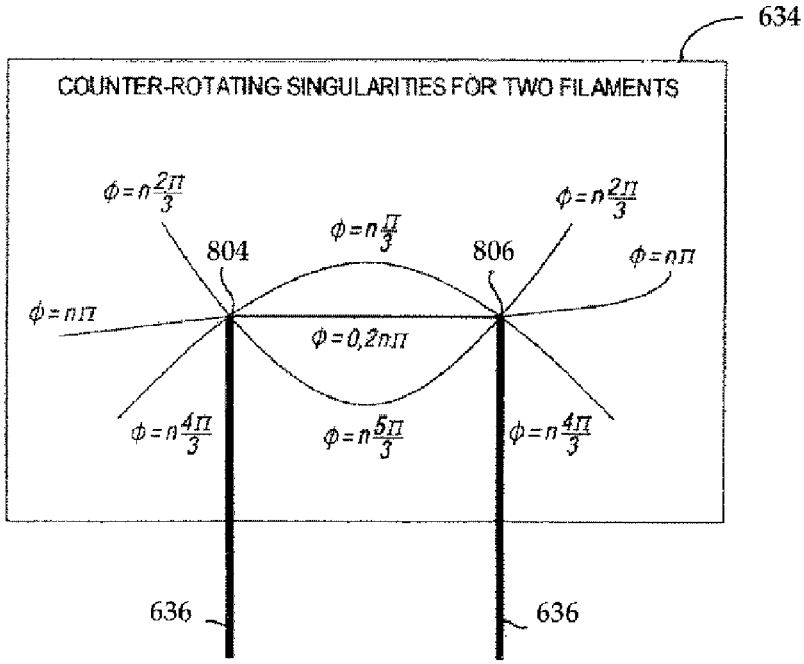

FIG. 8 shows a phase plates 634 for seeding two optical filaments 636. The phase plate 634 of FIG. 8 has counter-rotating singularities 804, 806.

Accordingly, the present invention provides a method to improve RF propagation via a transmission line generated by an ultra-short pulse laser. By coupling selected RF modes to a dual conductive channel (two line transmission line) generated via short pulse laser induced plasma channel, the present invention provides better than $1/R^2$ propagation (RF power radiated falls off by distance squared neglecting ground bounce and other phenomena); lower frequency RF launch in smaller aperture size; and optically directed scanning of RF. Still other advantages and consequences of the invention may become apparent to those skilled in the art having the benefit of this disclosure. Note that not all embodiments will necessarily employ all the same features or yield all the same benefits.

The present invention may find many applications. Electromagnetic energy such as the RF signal 110 in FIG. 1 can be used in many ways to sense or affect objects from a distance. Radar, for example, is reflected electromagnetic energy used to determine the velocity and location of a targeted object. It is widely used in such applications as aircraft and ship navigation, military reconnaissance, automobile speed checks, and weather observations. Electromagnetic energy may also be used to jam or otherwise interfere with radio frequency transmissions or to affect the radio transmitting equipment itself.

Each of the embodiments described above employs an apparatus that both generates the plasma filaments and transmits the RF signal down the resultant transmission line. In some alternative embodiments, however, this may vary. For example, in a receive-only mode, the RF energy may instead be generated at the target by the laser pulse or within the plasma volume of the of the plasma filaments at the target or near the target. This allows use of the system to transmit back an optically generated, lower frequency signal, or a plasma induced signal, via the transmission line.

The following documents are hereby incorporated by reference as if expressly set forth verbatim in this specification for the listed subject matter:

U.S. Pat. No. 7,050,469, entitled "Generation of Optical Filaments by Use of Phase Plate", issued May 23, 2006, to Ionatron as assignee of the inventors Paul B. Lundquist and Stephen William McCahon, for its disclosure of a injection technique for generating plasma filaments (which they refer to as "optical filaments");

U.S. Pat. No. 5,726,855, entitled "Apparatus and Method for Enabling the Creation of Multiple Extended Conduction Paths in the Atmosphere", issued Mar. 10, 1998, to The Regents of The University Of Michigan and The University of New Mexico as assignees for the inventors Gerard Mourou, et al., for its disclosure regarding an apparatus (an USPL) and a technique for generating plasma filaments; and Thomas Pfeifer, et al., "Circular Phase-Mask for Control and Stabilization of Optical Filaments," Optics Letters 22 May 2006 doc 68241, disclosing the use of a Hamamatsu reflective phase plate to generate single filaments with reduced spatial variation, and improved aiming repeatability pulse to pulse;

U.S. Provisional Application Ser. No. 60/912,373; entitled, "Method and Apparatus for Optical Filament Launch"; filed Apr. 17, 2007, filed in the name of the inventors James R. Wood and Mark K. Browder for all that it discloses, teaches, and suggests.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method, comprising generating a plurality of plasma filaments defining a radio frequency transmission line through an ambient atmosphere.

2. The method of claim 1, further comprising transmitting a radio frequency signal through the propagation path.

3. The method of claim 1, wherein the plasma filaments and the radio frequency signal are pulsed in synchronicity.

4. The method of claim 1, wherein generating the plasma filaments includes transmitting a plurality of laser signals to ionize the ambient atmosphere.

5. The method of claim 4, wherein transmitting the plurality of laser signals includes generating a plurality of laser beams.

6. The method of claim 4, wherein transmitting the plurality of laser signals includes:

generating a single laser beam; and splitting the laser beam.

7. The method of claim 1, wherein generating the plasma filaments includes generating plasma filaments using a reflection technique.

8. The method of claim 1, wherein generating the plasma filaments includes generating plasma filaments using an injection technique.

9. The method of claim 1, wherein generating the plurality of plasma filaments includes pulsing a laser signal to ionize the ambient atmosphere.

10. The method of claim 9, wherein generating the plasma filaments includes generating plasma filaments using a reflection technique.

11. The method of claim 9, wherein generating the plasma filaments includes generating plasma filaments using an injection technique.

12. An apparatus comprising a radio frequency transmission line defined by a plurality of plasma filaments through an ambient atmosphere.

13. An apparatus comprising:

a radio frequency waveguide defining an exit aperture; and means for generating an optically steered and optically generated plasma filament transmission line structure comprised of a plurality of plasma filaments, the transmission line structure having an optical axis of steering pivoted around the end points of the radio frequency waveguide defining the exit aperture.

14. The apparatus of claim 13, wherein the radio frequency waveguide mechanically tapers toward the exit aperture.

15. A method, comprising generating a pulsed plasma filament radio frequency transmission line through an ambient atmosphere.

16. The method of claim 15, further comprising transmitting a radio frequency signal down the transmission line.

17. An radio frequency transmission line comprised of a pulsed plasma filament defined radio frequency transmission line through an ambient atmosphere.

18. An apparatus, comprising:

means for generating a pulsed optical signal to ionize an ambient atmosphere and define a radio frequency transmission line; and a radio frequency transmitter capable of transmitting an radio frequency signal in synchronicity with the pulses of the optical signal.

19. The apparatus of claim 18, wherein the generating means includes an ultra short pulse laser.

20. The apparatus of claim 18, wherein the generating means includes means for generating a plurality of pulsed optical signals.

21. The apparatus of claim 18, wherein the radio frequency transmitter includes a radio frequency waveguide that mechanically tapers toward the exit aperture thereof.

* * * * *